US012543901B2

(12) United States Patent
Higgins

(10) Patent No.: US 12,543,901 B2
(45) Date of Patent: Feb. 10, 2026

(54) RAISED TOILET SEAT WITH REMOVABLE HANDRAILS

(71) Applicant: Cross Innovations LLC, Cheyenne, WY (US)

(72) Inventor: Shawn Higgins, Cheyenne, WY (US)

(73) Assignee: Cross Innovations LLC, Cheyenne, WY (US)

( * ) Notice: Subject to any disclaimer, the term of this patent is extended or adjusted under 35 U.S.C. 154(b) by 103 days.

(21) Appl. No.: 18/628,123

(22) Filed: Apr. 5, 2024

(65) Prior Publication Data

US 2025/0311897 A1 Oct. 9, 2025

(51) Int. Cl.

| | |
|---|---|
| ***A47K 13/00*** | (2006.01) |
| ***A47K 13/26*** | (2006.01) |
| ***A47K 17/02*** | (2006.01) |

(52) U.S. Cl.

CPC ..... *A47K 13/005* (2013.01); *A47K 13/26* (2013.01); *A47K 17/026* (2013.01)

(58) Field of Classification Search

CPC ..... A47K 13/005; A47K 17/026

See application file for complete search history.

(56) References Cited

U.S. PATENT DOCUMENTS

| | | | | |
|---|---|---|---|---|
| 7,073,210 | B2 * | 7/2006 | Jiang | A47K 13/005 4/237 |
| 2021/0338022 | A1 * | 11/2021 | Roff | A47K 17/028 |
| 2021/0345842 | A1 * | 11/2021 | Savioli | A47K 13/005 |
| 2023/0233042 | A1 * | 7/2023 | Arndt | A47K 13/105 4/240 |

* cited by examiner

*Primary Examiner* — Christine J Skubinna

(74) *Attorney, Agent, or Firm* — Fish & Richardson P.C.

(57) ABSTRACT

Implementations of a toilet seat system can include a raised toilet seat having a set of cavities formed therein, cavities in the set of cavities being configured to receive inserts, and a handrail including a rail and an insert that is releasably secured within a cavity of the set of cavities.

18 Claims, 17 Drawing Sheets

RAISED TOILET SEAT WITH REMOVABLE HANDRAILS

BACKGROUND

Use of a toilet can require an individual to be in a seated position over the toilet. This requires vertical displacement of the individual from a standing position to a seated position. For some individuals, such vertical movement can be difficult and uncomfortable. For example, an elderly individual and/or an individual suffering from an injury or other motion-limiting condition can find it difficult, uncomfortable, and/or painful to transition to a seated position on the toilet. In some instances, it can be similarly difficult, uncomfortable, and/or painful to transition from the seated position to the standing position.

To alleviate this, modifications have been introduced to assist individuals in transitions between seated and standing positions and/or to reduce the vertical displacement to transition between seated and standing positions. Conventional modifications can include, for example, handrails and raised toilet seats. For example, handrails attached to or near a toilet can be used to distribute a portion of a load (e.g., body weight) from the legs and lower back to the arms. This can reduce the amount of strain on weakened or injured muscles (e.g., reducing a strain on lower back muscles). As another example, raised toilet seats reduce the vertical displacement required to transition between seated and standing positions. This reduces the amount of time the body is weight-loaded (e.g., muscles, joints) during transition.

However, conventional modifications suffer from various drawbacks. For example, handrails can be difficult to install and can be aesthetically displeasing. Further, handrails can introduce opportunities for collection of fluids, dirt, and debris, which can be difficult to clean, resulting in unhygienic environments. As another example, conventional raised toilet seats sit atop the toilet bowl requiring a toilet seat and/or lid to stay in a raised position. That is, the toilet seat and/or lid cannot be lowered to cover the toilet bowl, for example. As another example, conventional raised toilet seats can attach to a toilet seat, which results in gaps that introduce opportunities for collection of fluids, dirt, and debris, which can be difficult to clean, resulting in unhygienic environments.

SUMMARY

Implementations of the present disclosure are generally directed to toilet seats. More particularly, implementations of the present disclosure are directed to a toilet seat system that includes a raised toilet seat and removable handrails.

In some implementations, a toilet seat system includes a raised toilet seat having a set of cavities formed therein, cavities in the set of cavities being configured to receive inserts, and a handrail including a rail and a first insert that is releasably secured within a first cavity of the set of cavities.

These and other implementations can each optionally include one or more of the following features: the first insert is insertable into the first cavity in a horizontal direction; the handrail further includes a second insert that can be releasably secured within a second cavity of the set of cavities; the first insert includes a quick-release mechanism that is configured to releasably secure the first insert within the first cavity; the quick-release mechanism includes a button that is selectively receivable within an opening to releasably secure the first insert within the first cavity; the first cavity includes a sloping surface that acts on the quick-release mechanism when the first insert is inserted into the first cavity; the toilet seat system further includes a hinge assembly including a quick-detachment mechanism that is configured to releasably secure the toilet seat system to a toilet bowl; the quick-detachment mechanism including a mounting bracket that is secured to the toilet bowl, a latch that is movable between a first position and a second position, in the first position, the latch being engaged with the mounting bracket and, in the second position, the latch being disengaged from the mounting bracket, and a release button that is movable to induce movement of the latch from the first position to the second position; each cavity in the set of cavities is integrally formed within the raised toilet seat; the toilet seat system further includes a plug that is releasably secured within a second cavity of the set of cavities; the rail is a tubular rail; and the toilet seat system further includes a lid.

The details of one or more implementations of the present disclosure are set forth in the accompanying drawings and the description below. Other features and advantages of the present disclosure will be apparent from the description, drawings, and claims.

BRIEF DESCRIPTION OF DRAWINGS

Like reference numbers and designations in the various drawings indicate like elements.

DETAILED DESCRIPTION

Figure 1:
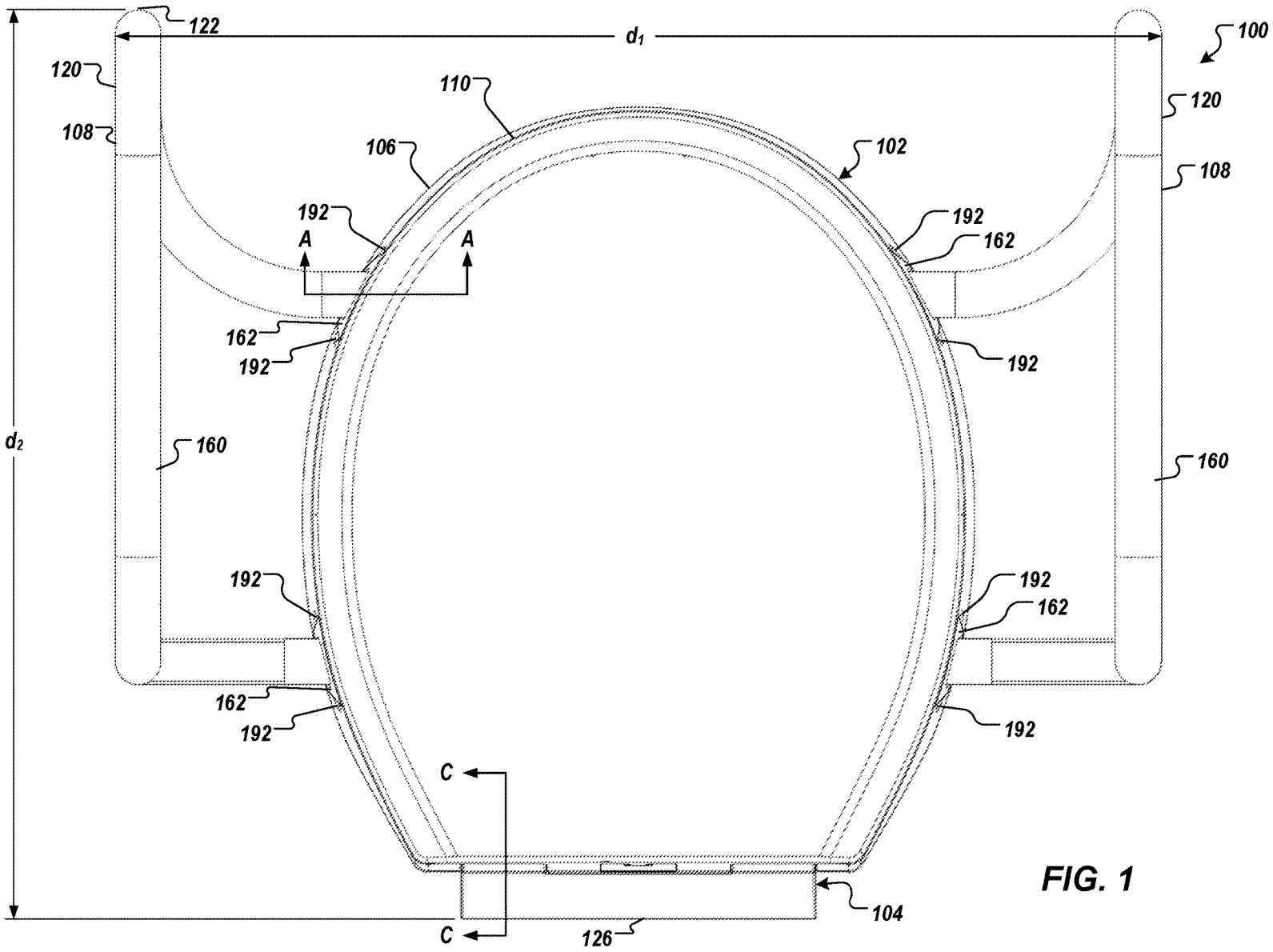
FIGS. 1-9 depict respective views of a toilet seat system in accordance with implementations of the present disclosure.
Figure 2:
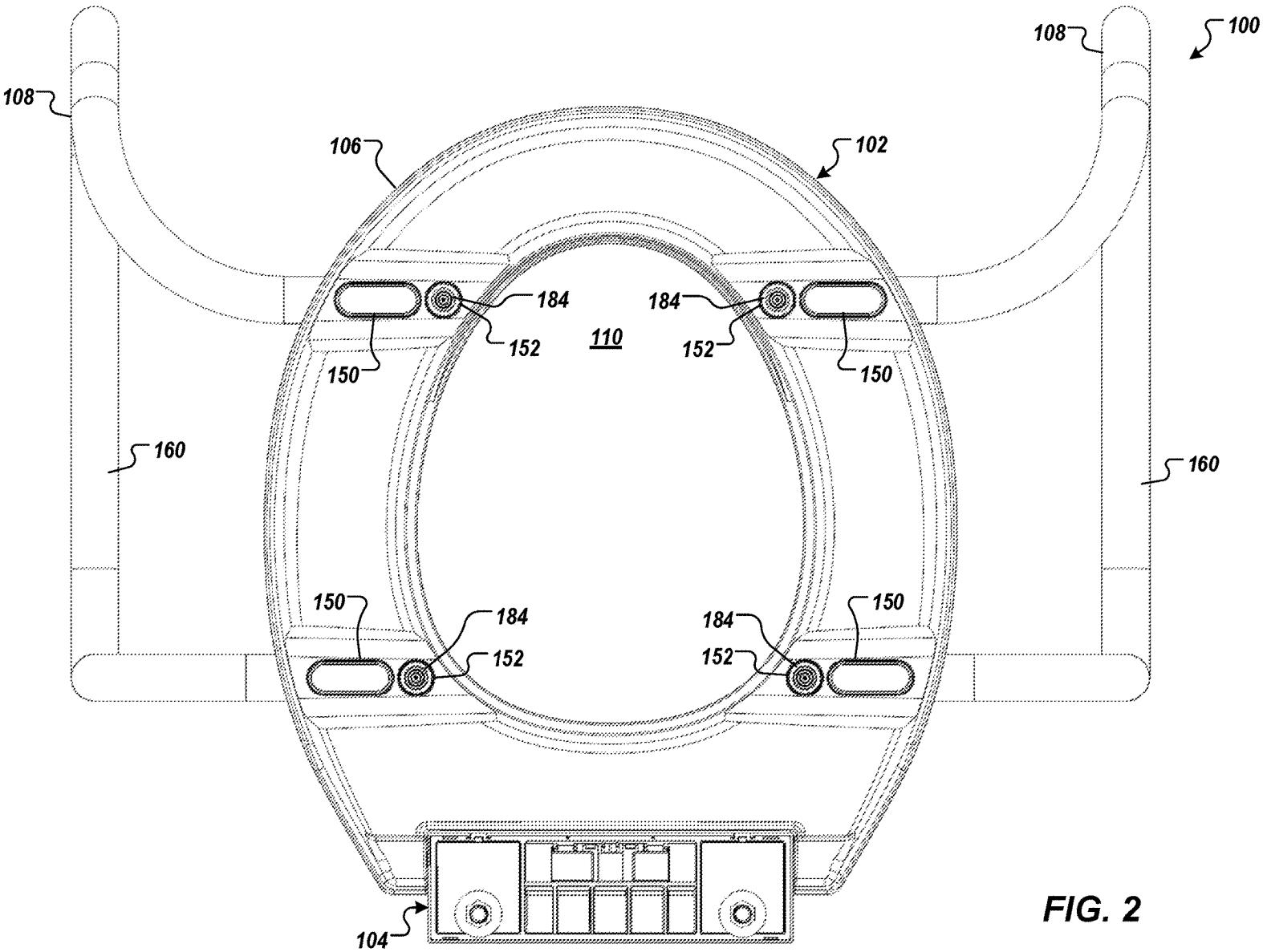

Implementations of the present disclosure are generally directed to toilet seats. More particularly, implementations of the present disclosure are directed to a toilet seat system that includes a raised toilet seat and removable handrails. Implementations of the toilet seat system of the present disclosure include a standard configuration and an elongated configuration.

In some implementations, a toilet seat system includes a raised toilet seat having a set of cavities formed therein, cavities in the set of cavities being configured to receive inserts, and a handrail including a rail and an insert that is releasably secured within a cavity of the set of cavities.

As described in further detail herein, implementations of the toilet seat system of the present disclosure provide numerous advantages over conventional approaches. In some implementations, the toilet seat system of the present disclosure includes a toilet seat assembly that includes a raised toilet seat with removable handrails. The raised toilet seat can be moved between a down position and an up position. The toilet seat system includes a lid that can be moved between the down position (closed) and the up position (open). As described herein, the handrails can be attached and detached from the toilet raised toilet seat with relatively little effort enabling users that are either not mechanically inclined and/or have some condition inhibiting manual labor to manage these tasks. As also described herein, the handrails are removable in a horizontal direction, such that ingress of dirt, debris, fluids, and the like into cavities that the handrails are mounted in is inhibited. The handrails can be detached to enhance the aesthetics of the toilet seat system and/or for cleaning. When the handrails are removed, plugs can be inserted into the cavities to enhance the appearance of the toilet seat system and to inhibit ingress of dirt, debris, fluids, and the like. In some implementations, the toilet seat system includes a hinge assembly that enables attachment and detachment of the toilet seat system from a toilet bowl. As described herein, the toilet seat system can be attached and detached from the toilet bowl with relatively little manual effort enabling users with that are either not mechanically inclined and/or have some condition inhibiting manual effort to manage these tasks. Further, the toilet seat system can be readily detached for cleaning of the toilet seat system and/or the toilet bowl.

FIGS. 1-9 depict respective views of a toilet seat system 100 in accordance with implementations of the present disclosure. The toilet seat system 100 includes a toilet seat assembly 102 and a hinge assembly 104. The toilet seat assembly 102 includes a raised toilet seat 106, handrails 108, and a lid 110.

Figure 3:
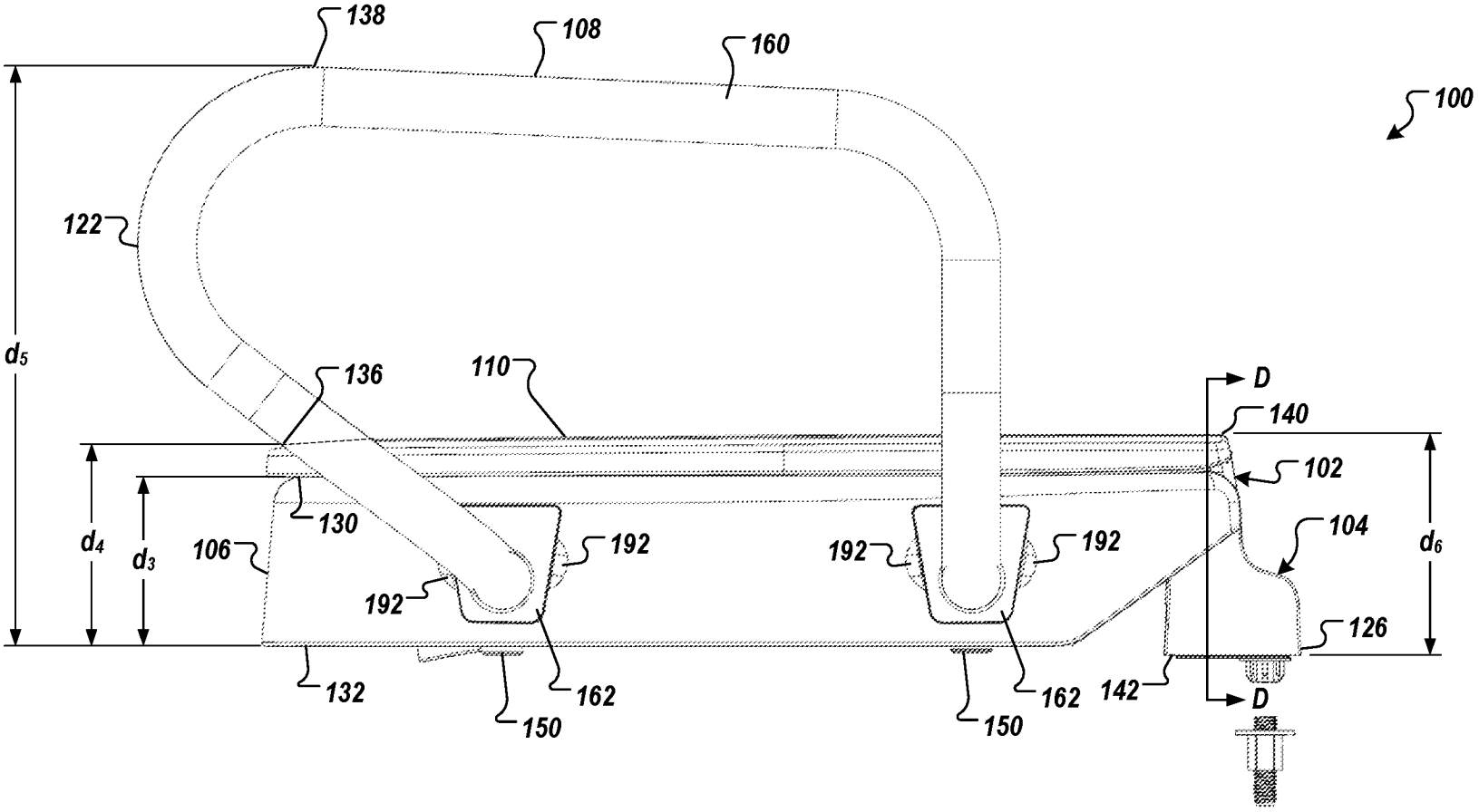
Figure 4:
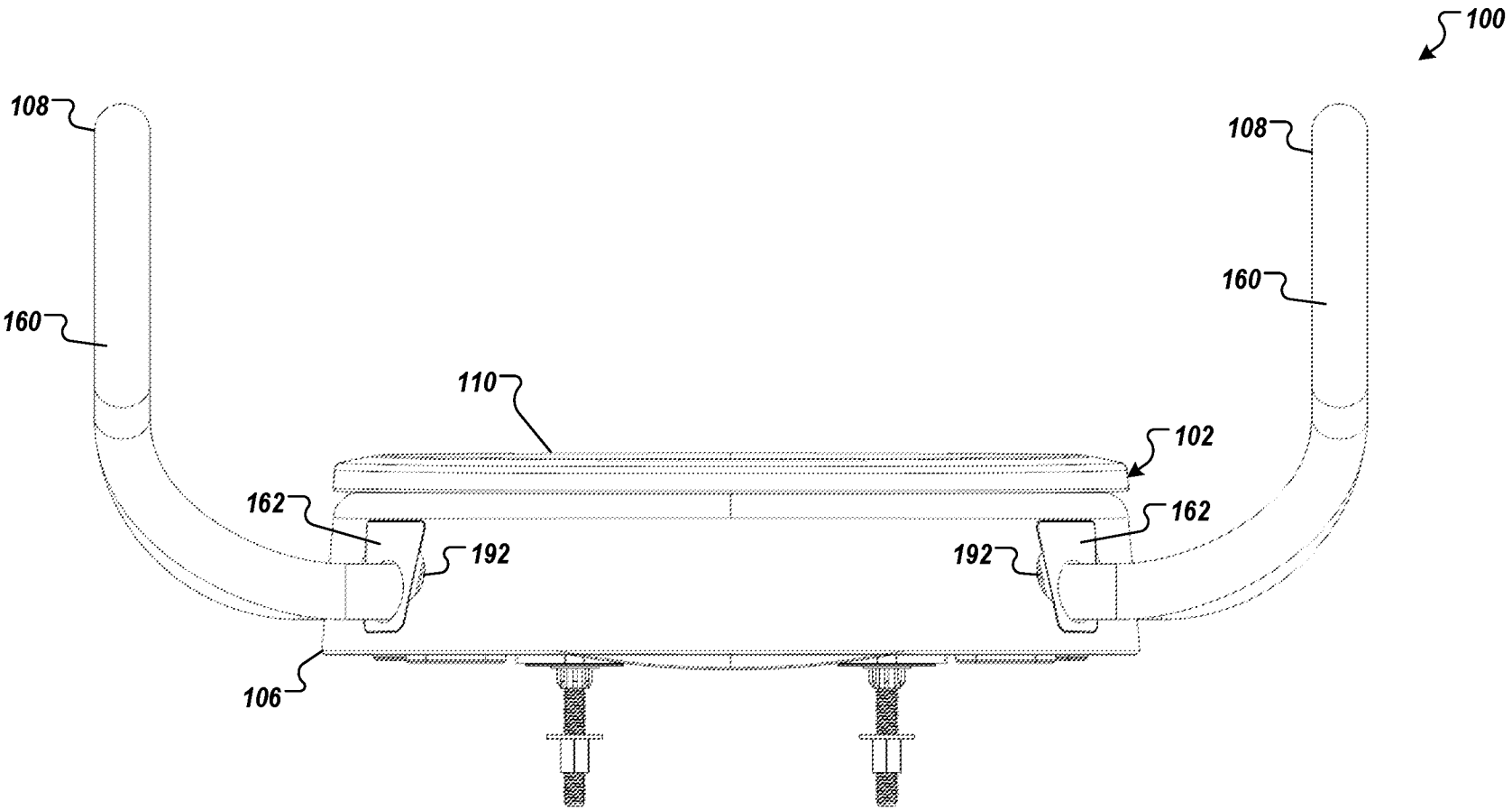

With particular reference to FIG. 1, a dimension $d_1$ represents a distance between outside edges 120 of the handrails 108, a dimension $d_2$ represents a distance between the front edges 122 of the handrails 108 and a rear face 126 of the hinge assembly 104. With particular reference to FIG. 3, a dimension $d_3$ represents a distance between a front location 130 and a bottom surface 132 of the raised toilet seat 106, a dimension $d_4$ represents a distance between a front location 136 of the lid 110 and the bottom surface 132 of the raised toilet seat 106, a dimension $d_5$ represents a distance between an upper edge 138 of the handrails 108 and the bottom surface 132 of the raised toilet seat 106, and a dimension $d_6$ represents a distance between a rear top surface 140 of the lid 110 and a bottom surface 142 of the hinge assembly 104. Tables 1 and 2 provide example values for each of the dimensions measured in millimeters (mm) for the standard configuration and the elongated configuration, respectively:

TABLE 1

Example Dimensions for Standard Configuration

| Dimension | Value | Tolerance |
|---|---|---|
| $d_1$ | 571.0 | ±3 |
| $d_2$ | 495.6 | ±3 |
| $d_3$ | 72.0 | ±2 |
| $d_4$ | 84.1 | ±2 |
| $d_5$ | 250.4 | ±2 |
| $d_6$ | 93.9 | ±2 |

TABLE 2

Example Dimensions for Elongated Configuration

| Dimension | Value | Tolerance |
|---|---|---|
| $d_1$ | 650.5 | ±3 |
| $d_2$ | 515.8 | ±3 |
| $d_3$ | 72.0 | ±2 |
| $d_4$ | 83.9 | ±2 |
| $d_5$ | 250.6 | ±2 |
| $d_6$ | 93.9 | ±2 |

As depicted in FIGS. 2 and 7-9, the raised toilet seat 106 includes pads 150 and quick-release openings 152. The pads 150 provide contact points between the raised toilet seat 106 and a toilet bowl (not shown). The quick-release openings 152 enable the handrails 108 to be secured to the raised toilet seat 106 and detached from the raised toilet seat 106, as described in further detail herein.

With particular reference to FIGS. 7-9, 11A, and 11B, attachment and detachment of the handrails 108 to and from the raised toilet seat 106 will be described in further detail. The handrails 108 include a tubular rail 160 and inserts 162. The inserts 162 are secured to respective ends of the tubular rail 160. In the depicted example, the tubular rail 160 includes a circular cross-section. It is contemplated, however, that the tubular rail 160 can be of any appropriate cross-sections or multiple cross-sections. Example cross-sections can include, without limitation, circular, oval, square, and rectangular. In some examples, the cross-section can change along the length of the tubular rail 160. For example, a first length of the tubular rail 160 can be of a first cross-section and a second length of the tubular rail 160 can be of a second cross-section that is different from the first cross-section. It is also contemplated that the rail need not be tubular, but can also be solid or partially solid in cross-section.

Figure 11A:
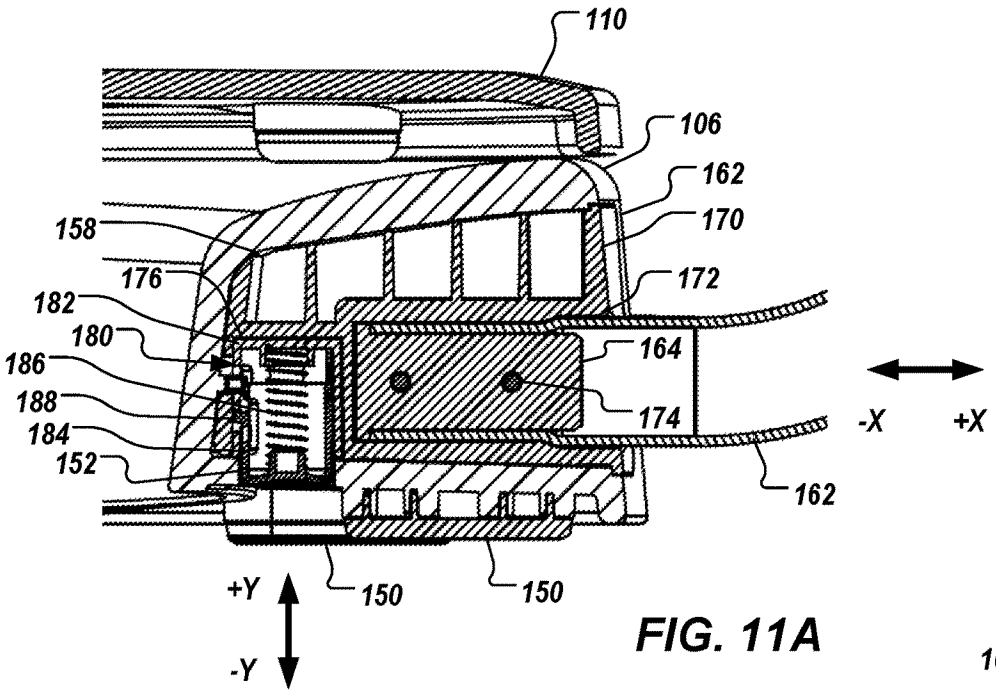
FIG. 11A depicts a cross-sectional view along line A-A of FIG. 1.

With particular reference to FIG. 11A, the raised toilet seat 106 includes cavities 158 formed therein for releasably securing the handrails 108 to the raised toilet seat 106. More particularly, the inserts 162 can be inserted into the cavities 158 to releasably secure the handrails 108 to the raised toilet seat 106. In some examples, the raised toilet seat 106 is formed to define the cavities 158. For example, the raised toilet seat 106 can be molded (e.g., plastic molding) to define the cavities 158 therein. As such, the cavities can be described as being integrally formed within the raised toilet seat 106.

In further detail, a plug 164 is inserted into each end of the tubular rail 160. As depicted in FIG. 11A, each insert 162 includes an insert body 170 that includes a hole 172 that receives an end of the tubular rail 160 for securing the tubular rail 160 to the insert body 170. In some examples, one or more fasteners 174 can be used to secure the tubular rail 160 to the insert body 170. It is contemplated, however, that any appropriate fastening means can be used (e.g., glue, epoxy, welding). The insert body 170 includes a hole 176 that receives a quick-release mechanism 180.

In the example of FIG. 11A, the quick-release mechanism 180 includes a casing 182, a button 184, and a spring 186. The button 184 is received within the casing 182 and is movable within the casing 182 in a +Y direction and a −Y direction. In some examples, a stop 188 prevents the button 184 from being completely removed from within the casing 182 in the −Y direction. The spring 186 biases the button 184 in the −Y direction, such that the button 184 is at least partially received in the quick-release opening 152. In some examples, the spring 186 biases the button 184 in the −Y direction to a point where the stop 188 prevents further movement of the button 184 in the −Y direction. This can be referred to as a fully-extended position.

When seated within the quick-release opening 152, the button 184 prevents the insert 162 from being withdrawn from the cavity 158. To remove the insert 162, and thus the handrail 108, from the cavity 158, the button 184 can be pushed in the +Y direction against the bias of the spring 186 until the button 184 clears the quick-release opening 150 and the insert 162 can be withdrawn from the cavity 158 in a +X direction. It can be noted that the +X/−X directions are horizontal and, as such, the cavities 158 open in a side-facing direction (e.g., as opposed to opening upward). Oriented in this way, ingress of dirt, debris, fluids, and the like into the cavity 158 is inhibited.

Figure 11B:
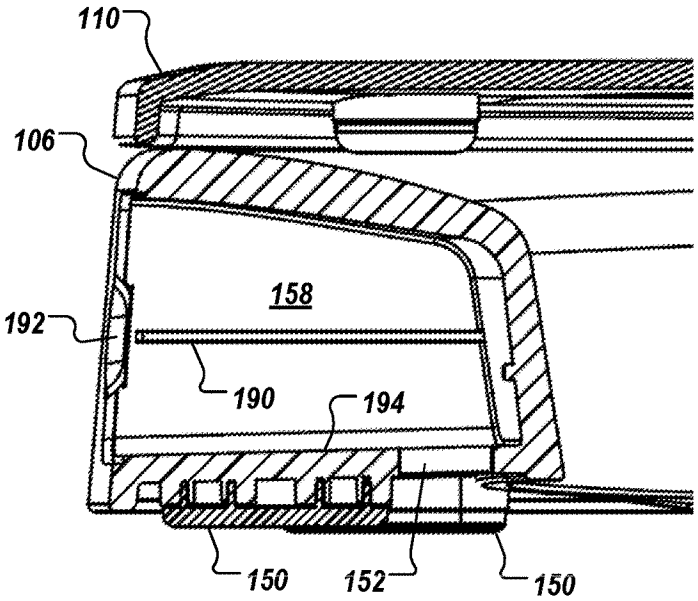
FIG. 11B depicts a cross-sectional view along line B-B of FIG. 7.
Figure 12:
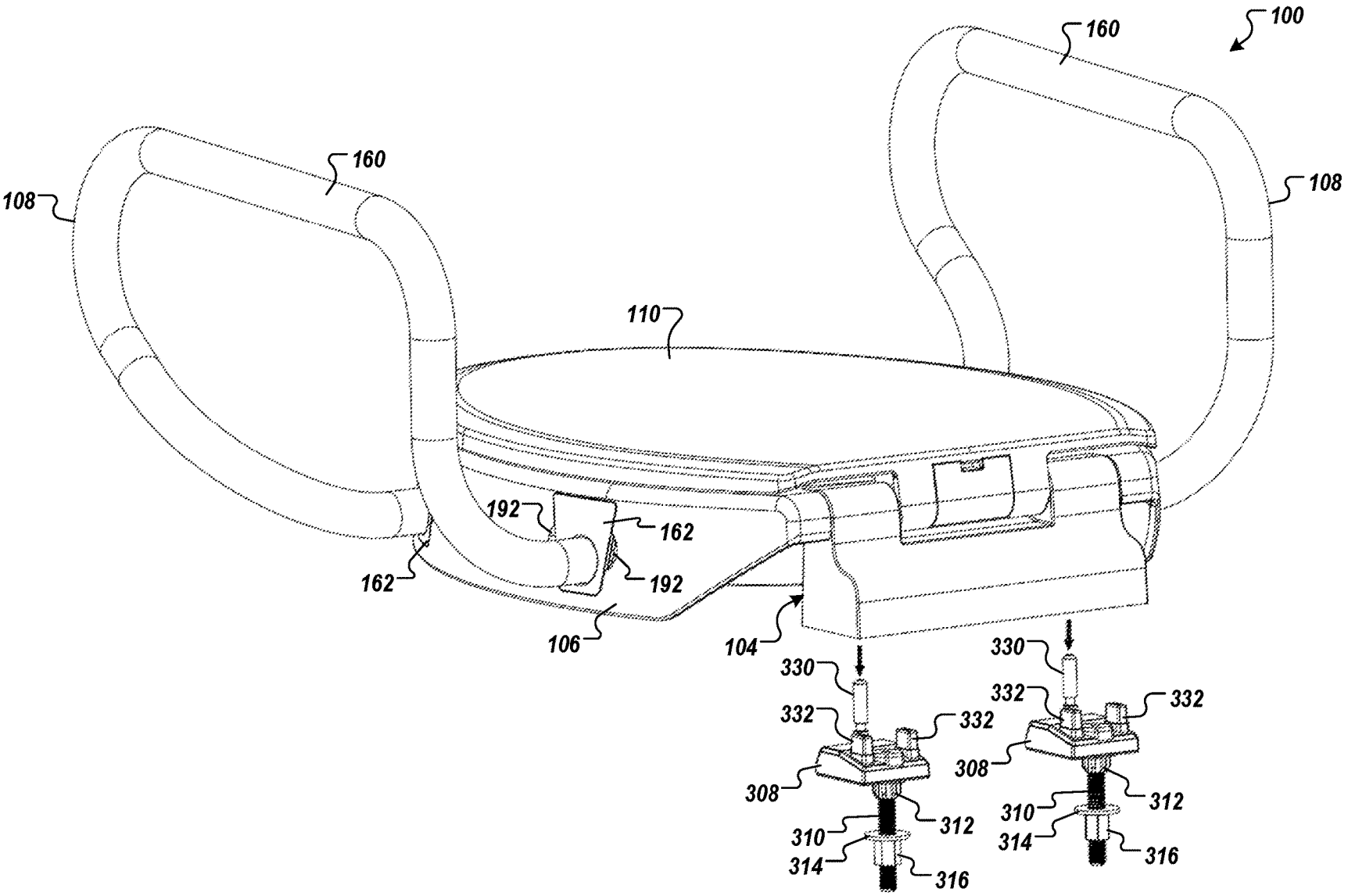
FIG. 12 depicts a perspective view of the toilet seat system in a detached condition.

With particular reference to FIG. 11B, the cavity 158 includes one or more guiderails 190, one or more recesses 192, and a sloping surface 194. In some examples, the one or more guiderails 190 are configured to be received within respective guide recesses 196 of the inserts 162 (see FIG. 9). In this manner, the guiderails 190 and the guide recesses 196 guide insertion and withdrawal of the inserts 162 into and from, respectively, the cavities 158. In some examples, the guide recess 196 is tapered, such that an end that initially receives the guiderail 190 is wider than a remainder of the guide recess 196. Although the cavity 158 is depicted as including the guiderails 158 and the insert 162 as having the guide recesses 196, it is contemplated that the cavity 158 can include one or more guide recesses and the insert 162 can include one or more guiderails.

When the insert 162 is inserted into the cavity 158, the button 184 can initially be in the fully-extended position (i.e., in the −Y direction). However, as the insert 162 travels deeper into the cavity 158, the button 184 comes into contact with the sloping surface 194, such that, as the button 184 slides along the sloping surface 194, the sloping surface 194 pushes the button 184 against the bias of the spring 186 in the +Y direction. When the insert 162 is fully inserted into the cavity 158, the button 184 is aligned with the quick-release hole 152 and the spring 186 biases the button 184 in the −Y direction to seat the button 184 within the quick-release hole 152. Accordingly, a user need not push the button 184 against the bias of the spring 186 in order to insert the insert 162 into the cavity 158.

In some examples, the recesses 192 case removal of the inserts 162 from the raised toilet seat 106. For example, the recesses 192 enable a user to grip the inserts 162 to pull the inserts 162 from the cavities 158.

Figure 8:
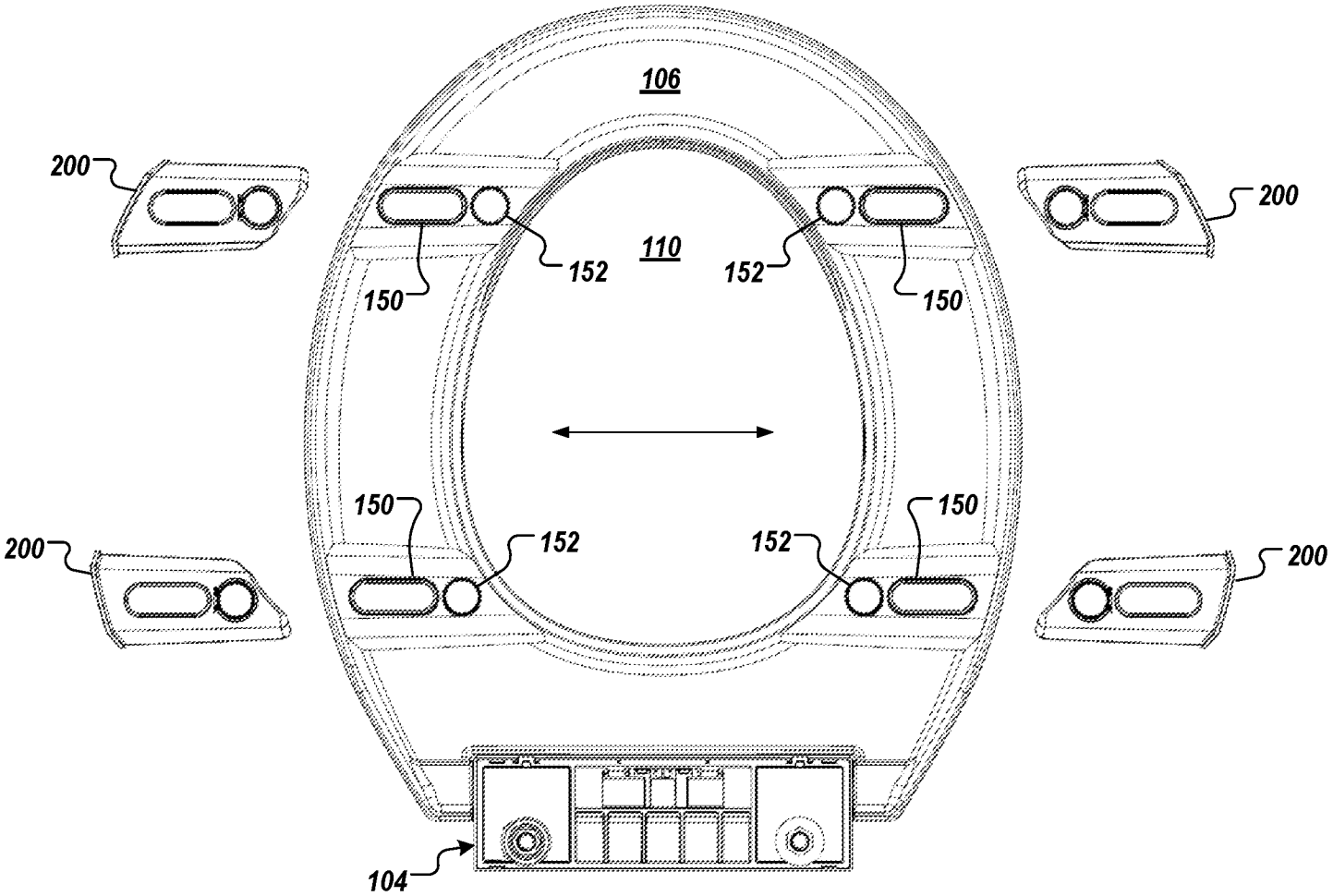

With particular reference to FIG. 8, when the handrails 108 are detached from the raised toilet seat 106, plugs 200 can be inserted into the cavities 158. Removal of the handrails 108 and insertion of the plugs 200 provides the toilet seat system 100 with a more aesthetically pleasing appearance in situations where the handrails 108 are not required. Although not depicted in detail, each plug 200 includes features of the insert 162, such as, a plug body, a quick-release mechanism, and one or more guide recesses. In this manner, the plugs 200 can be inserted into and withdrawn from the cavities 158 as similarly described herein with respect to the inserts 162. Here, the recesses 192 enable a user to grip the plugs 200 to pull the plugs 200 from the cavities 158.

Figure 9:
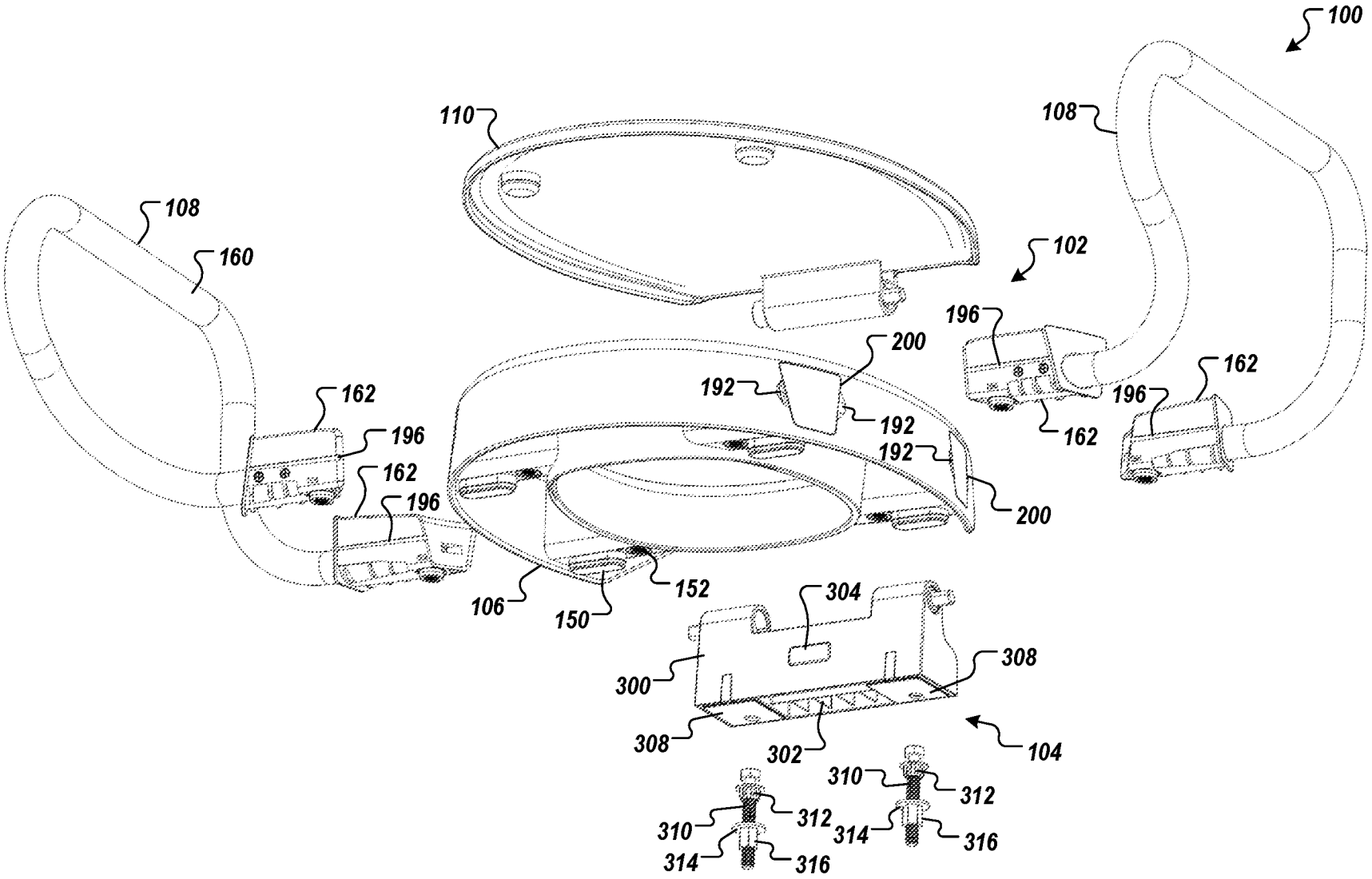

FIG. 9 depicts an exploded view of the toilet seat assembly 100 with the handrails 108 removed from the raised toilet seat 106 and the plugs 200 inserted into the raised toilet seat 106. Insertion of the plugs 200 not only provides a more aesthetically pleasing appearance when the handrails 108 are removed, but also prevents dirt, debris, fluids, and the like, from ingress into the cavities 158.

Figure 10:
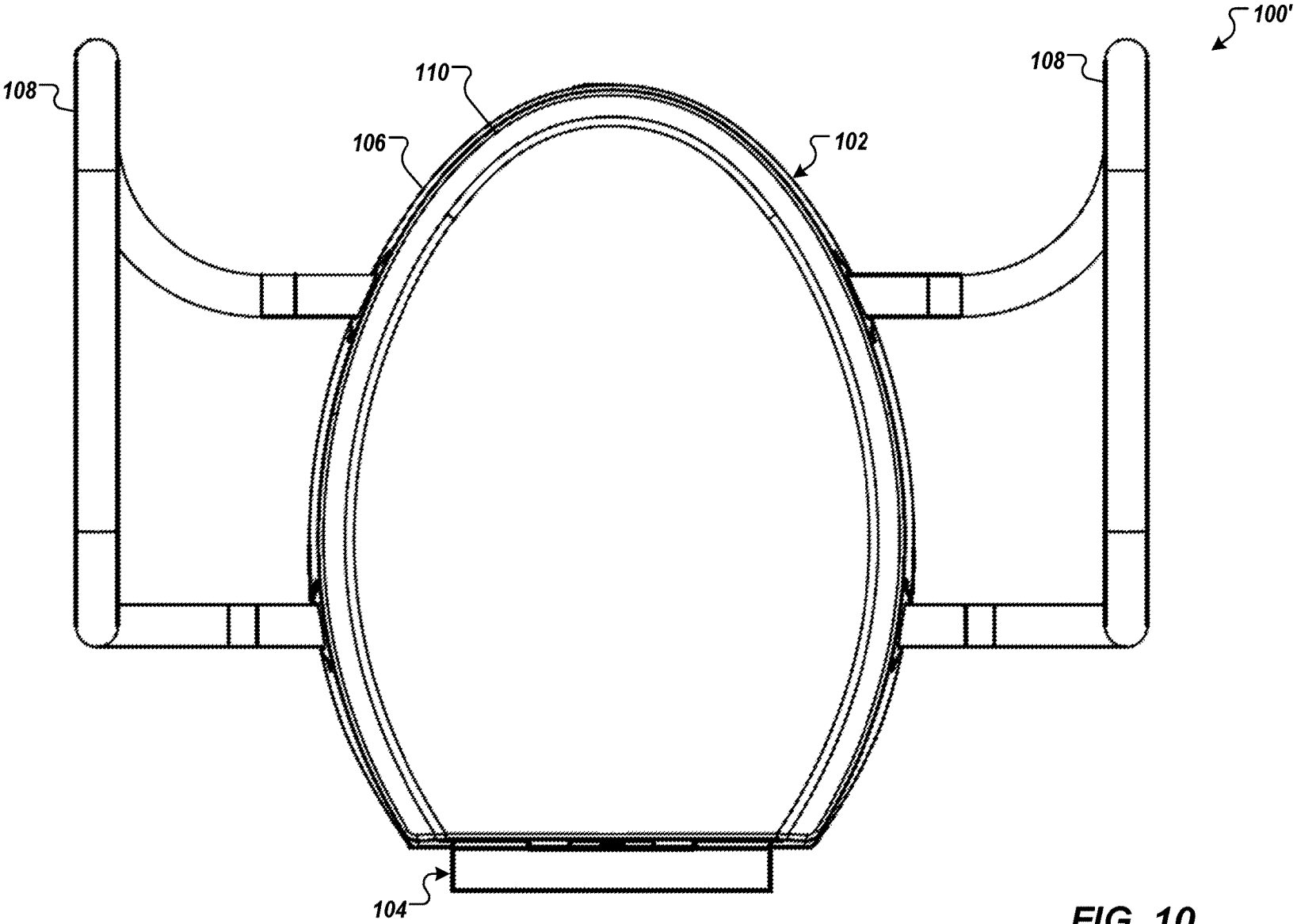
FIG. 10 depicts a top view of a toilet seat system in accordance with implementations of the present disclosure.

FIGS. 1-9 and 11A-15D depict the toilet seat system 100 having a standard configuration. FIG. 10 depicts a top view of a toilet seat system 100' having an elongated configuration. It is appreciated that components and functionality of the present disclosure are applicable to both the standard configuration and the elongated configuration. For example, while dimensions of some components can differ as between the standard configuration and the elongated configuration, quick-release and/or quick attachment components and/or functionality are consistent and/or the same as between the standard configuration and the elongated configuration. It is also contemplated that components and functionality of the present disclosure are applicable to other configurations, such as a rounded configuration.

The toilet seat assembly 100 of the present disclosure includes a quick-attachment system for quickly attaching and detaching the toilet seat assembly 100 from a toilet bowl. This is described in further detail with reference to FIGS. 9, 12, 13, 14, and 15A-15D.

Figure 14:
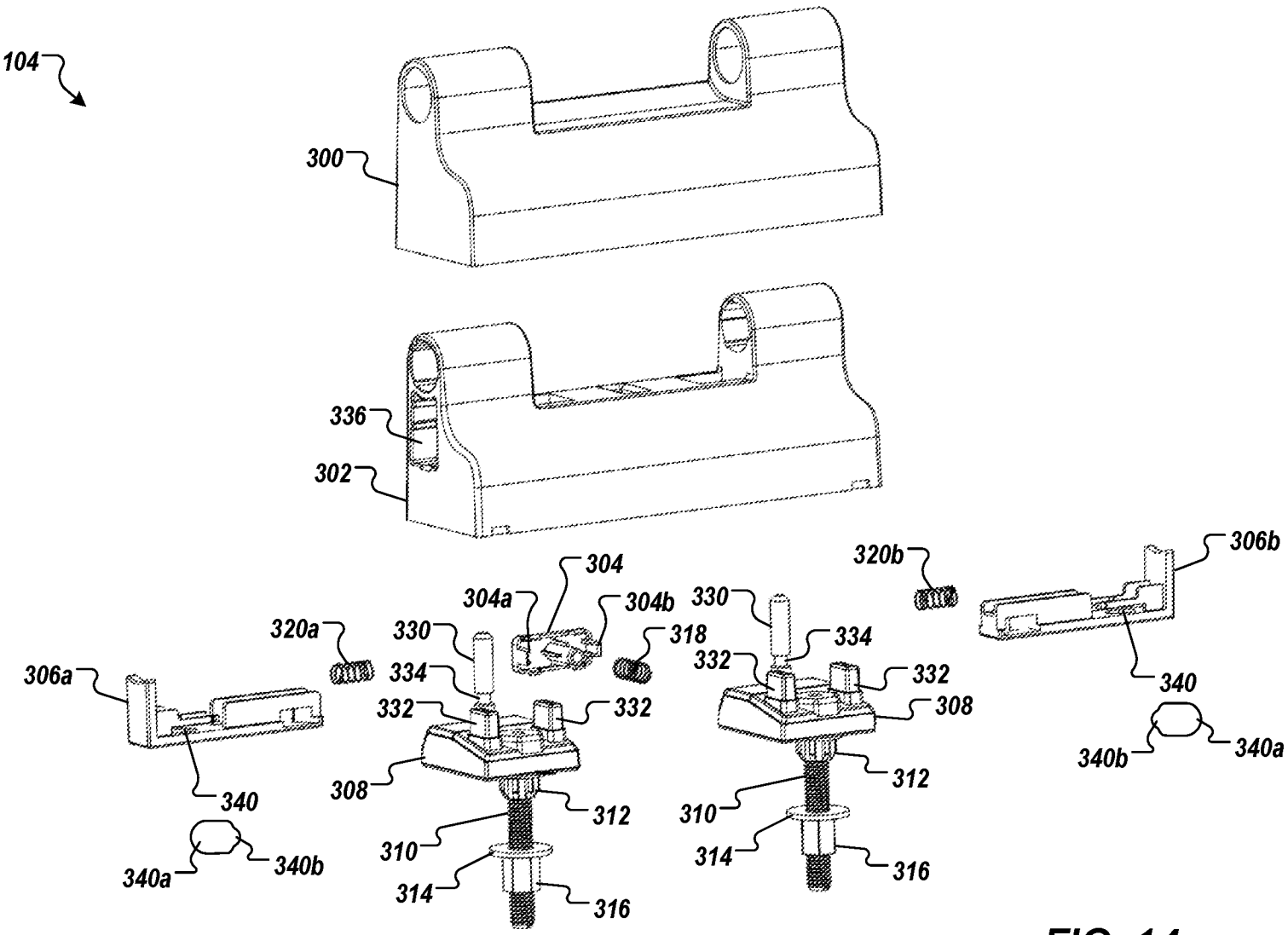
FIG. 14 depicts an exploded view of the hinge assembly.

With particular reference to FIG. 14, an exploded view of the hinge assembly 104 is depicted. In the example of FIG. 14, the hinge assembly 104 includes a cover 300, a hinge body 302, a release button 304, latches 306*a*, 306*b*, mounting brackets 308, bolts 310, centering nuts 312, washers 314, and nuts 316. The release button 304 includes cam surfaces 304*a*, 304*b*. The hinge assembly 104 further includes a button spring 318 and latch springs 320. Each mounting bracket 308 includes a mounting post 330 and one or more alignment posts 332. Each mounting post 330 includes a narrow 334 that has a smaller diameter than other portions of the mounting post 330. The hinge assembly 104 includes a quick-detachment mechanism that enables the toilet seat system 100 to be attached to and detached from a toilet bowl with relatively little manual effort and/or mechanical skill. In some examples, the quick-detachment mechanism includes at least the release button 304, the button spring 318, one or more of the latches 306*a*, 306*b*, one or more of the latch springs 320, and one or more of the mounting brackets 308.

The mounting brackets 308 can be securely attached to a toilet bowl (not depicted). For example, the bolts 310 can be received through respective holes of the mounting brackets 308 and the centering nuts 312 can be screwed onto the bolts 310 to secure the bolts 310 to the counting brackets 308. The bolts 310 can be inserted into mounting holes of the toilet bowl, the centering nuts 312 centering the bolts 310 in the mounting holes. The washers 314 can be slipped onto the bolts 310 and the nuts 316 can be screwed onto the bolts 310 to fasten the bolts 310, and thus the mounting brackets 308 to the toilet bowl.

Each latch 306*a*, 306*b* includes a hole 340 that is configured to receive one of the mounting posts 330. Further, the hinge body 302 includes channels 336 (only one channel 336 being visible in FIG. 14) that are configured to receive the latches 306*a*, 306*b*, such that the latches 306*a*, 306*b* are slidable within the channels 336. As described in further detail herein, in a first position, the mounting posts 330 are able to move through the holes 340 and, in a second position, the mounting posts 330 are unable to move through the holes 340. For example, an example profile of the holes 340 is depicted in FIG. 14, which includes a large radius end 340*a* and a small radius end 340*b*. In the first position, the narrows 334 of the mounting posts 330 are located in the large radius ends 340*a* and, in the second position, the narrows 334 of the mounting posts 330 are located in the small radius ends 340*b*, such that the latches 306*a*, 306*b* are seated within the narrows 334. In this manner, the narrows 334 of the mounting posts 330 prevent the latches 306*a*, 306*b*, and thus the toilet seat system 100, from upward movement to, for example, detach the toilet seat system 100 from a toilet bowl. Releasable attachment of the toilet seat system 100 is described in further detail with reference to FIGS. 15A-15F.

Figure 15A:
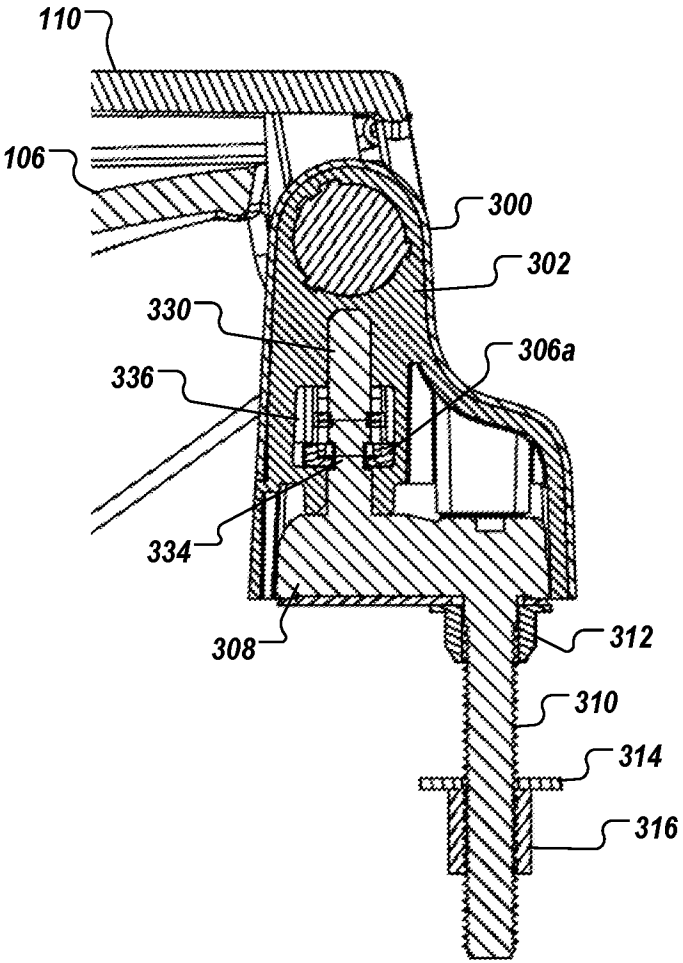
FIG. 15A depicts a cross-sectional view along line C-C of FIG. 1.

FIG. 15A depicts a cross-sectional view along line C-C of FIG. 1. In the example of FIG. 15A, the latch 306*a* is in the first position, in which the smaller radius end 340*b* of the hole 340 is located within the narrow 334 of the mounting post 330, such that the latch 306*a* is seated in the narrow 334.

Figure 15B:
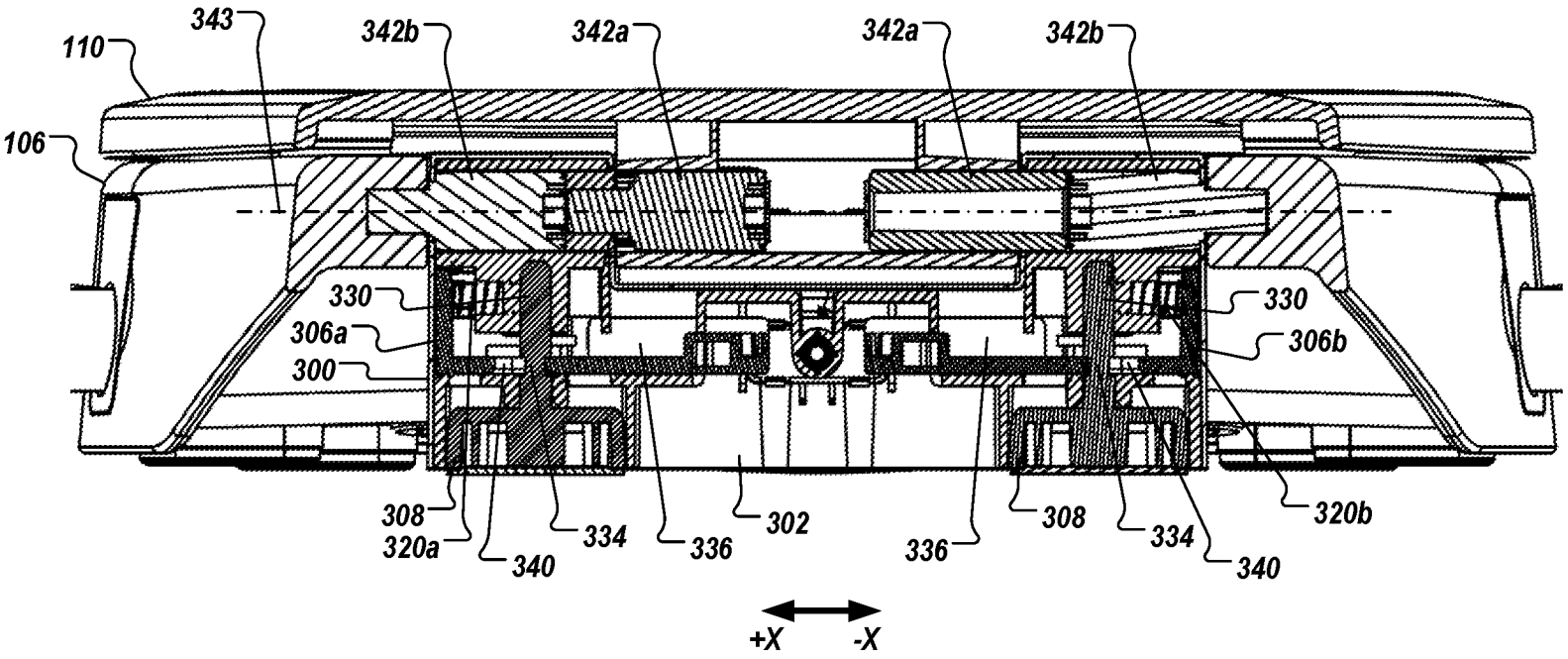
FIG. 15B depicts a cross-sectional view along line D-D of FIG. 3.

FIG. 15B depicts a cross-sectional view along line D-D of FIG. 3. In the example of FIG. 15B, the latches 306*a*, 306*b* in respective first positions, in which the smaller radius ends 340*b* of the holes 340 are located within the narrows 334 of the mounting posts 330, such that the latches 306*a*, 306*b* are seated in the narrows 334. As can be seen in FIG. 15B, the spring 320*a* biases the latch 306*a* in a +X direction, such that the latch 306*a* is pressed against an inside surface of the cover 300, and the spring 320*b* biases the latch 306*b* in a −X direction, such that the latch 306*b* is pressed against an inside surface of the cover 300. For example, each spring 320 is positioned between a surface of the hinge body 302 and a surface of the latch 306, 306*b*, respectively.

Figure 13:
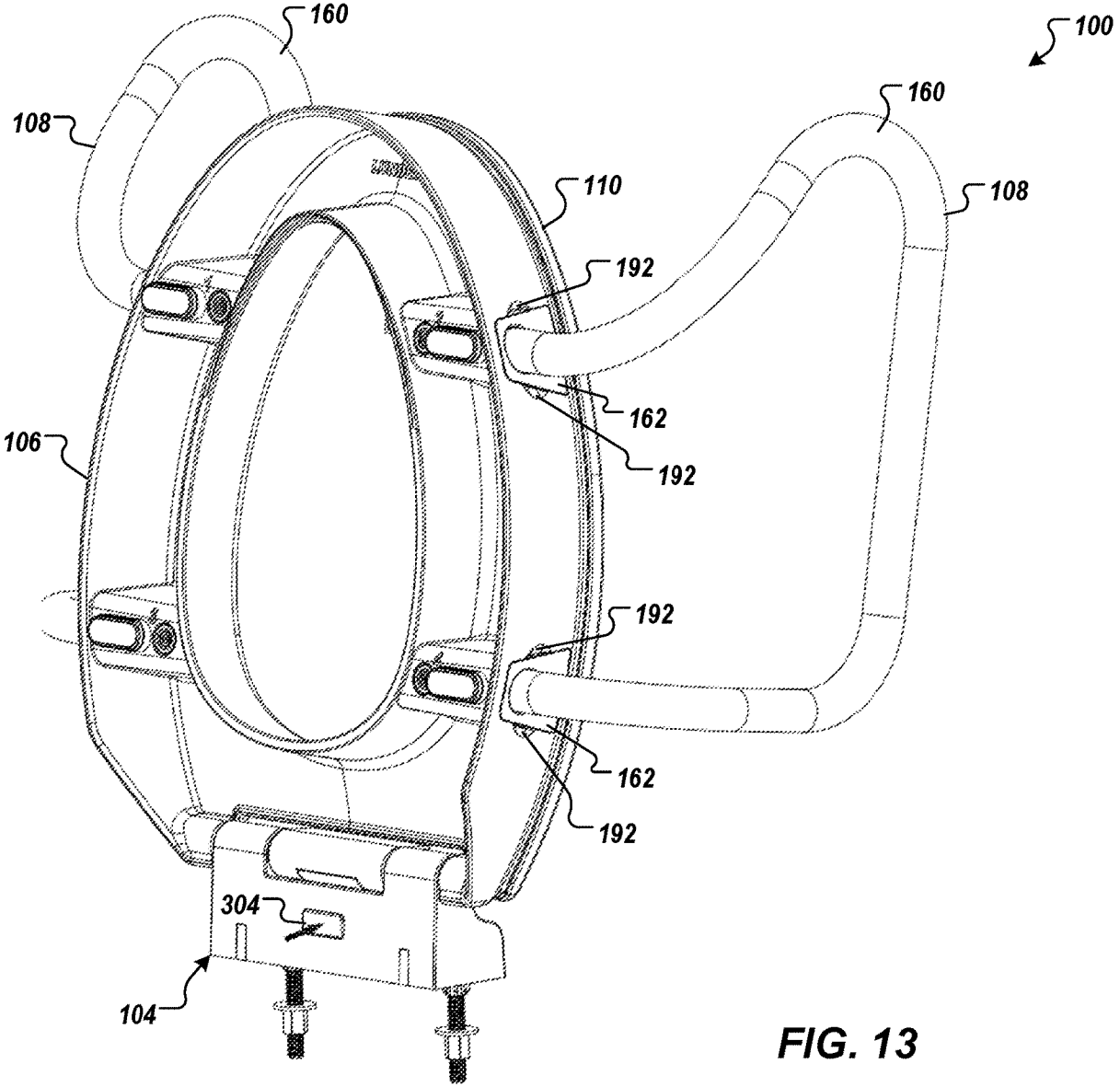
FIG. 13 depicts a perspective view of the toilet seat system in a raised position.

FIG. 15B also depicts hinge mechanisms 342*a*, 342*b*, which enable pivoting of the raised toilet seat 306 and the lid 310 about an axis 343. In some examples, one or more of the hinge mechanisms 342*a*, 342*b* is a soft-close hinge mechanism that enables relatively slow movement of the raised toilet seat 306 and/or the lid 310 from an up position (e.g., as depicted in FIG. 13) to a down position (e.g., as depicted in FIG. 3).

Figure 5:
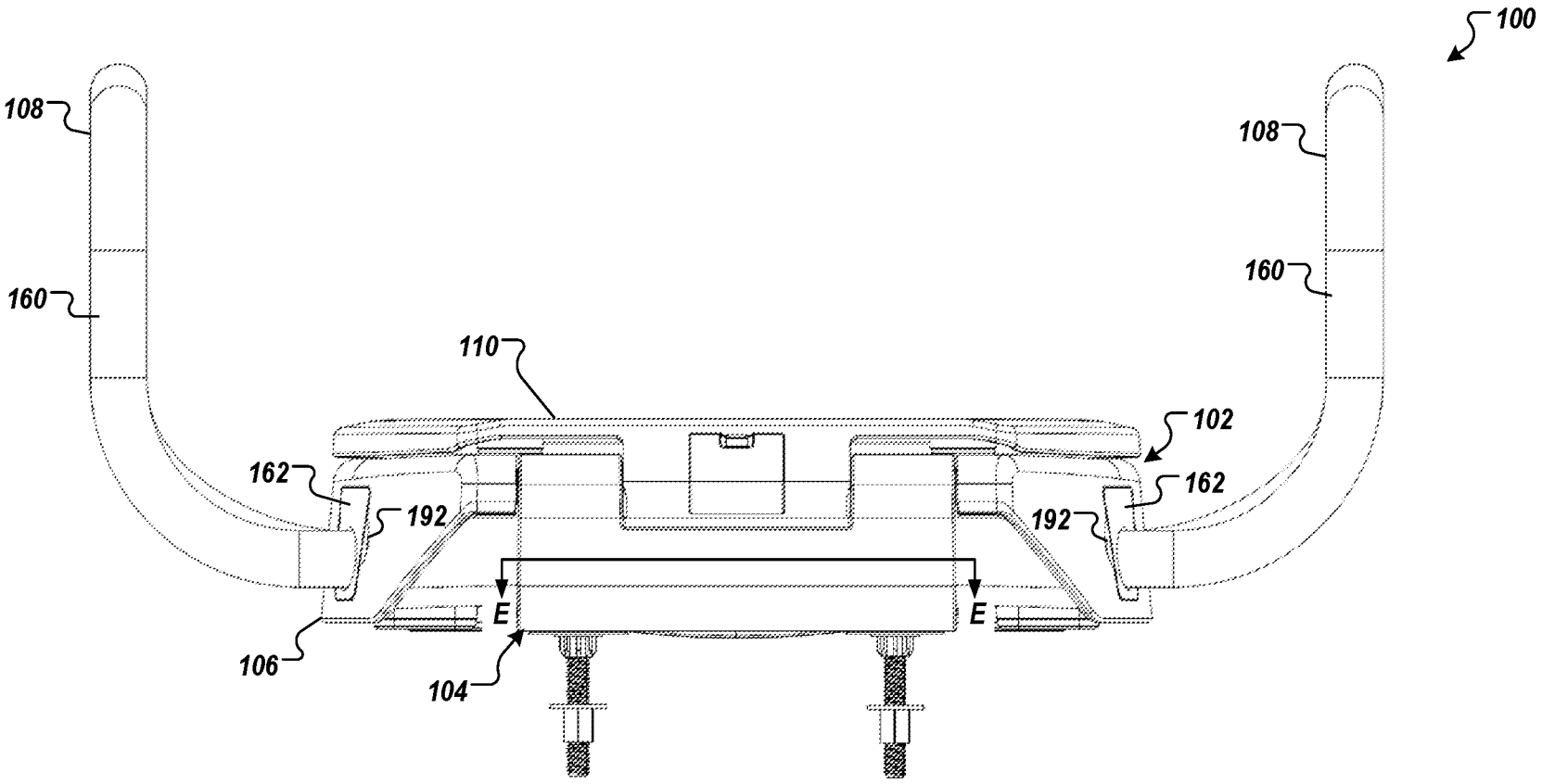
Figure 6:
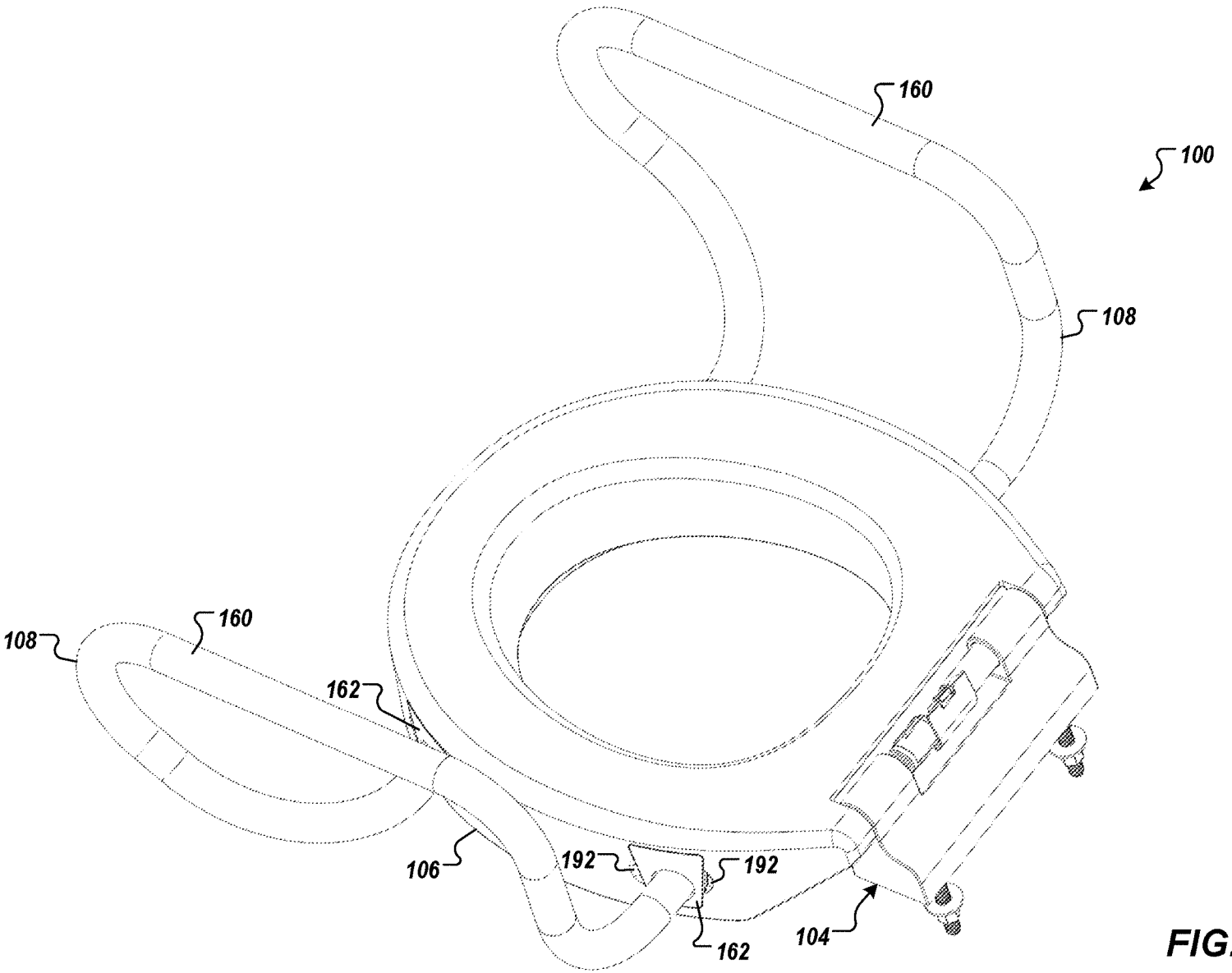
Figure 7:
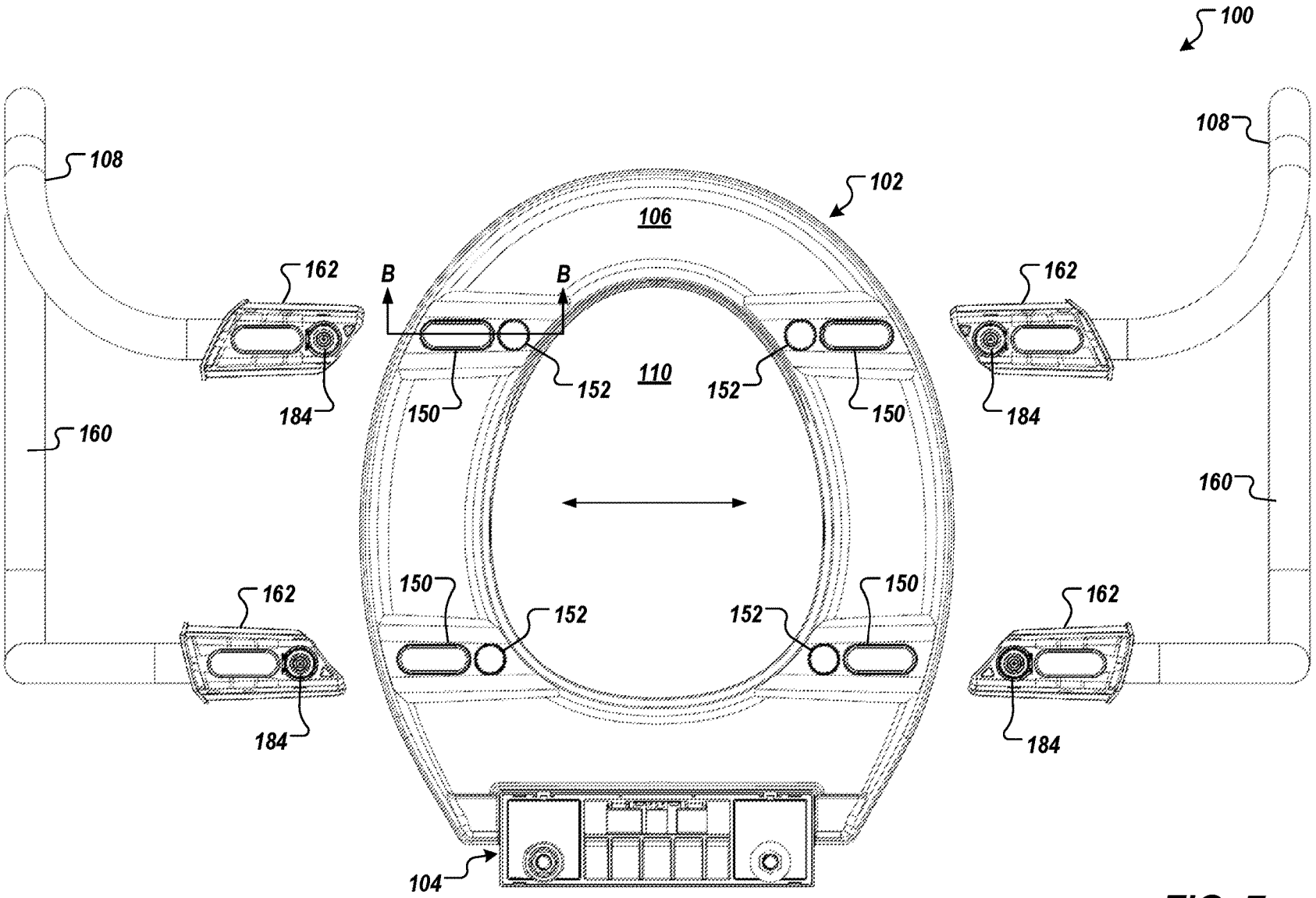
Figure 15C:
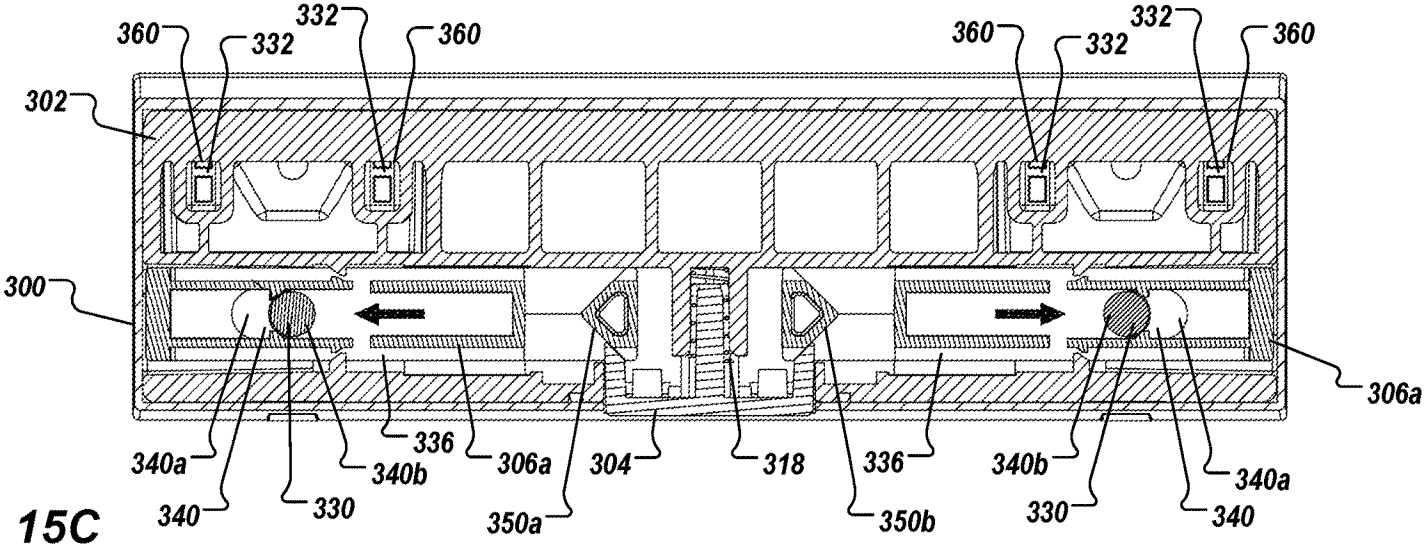
FIGS. 15C and 15D depict respective cross-sectional views along line E-E of FIG. 5.
Figure 15D:
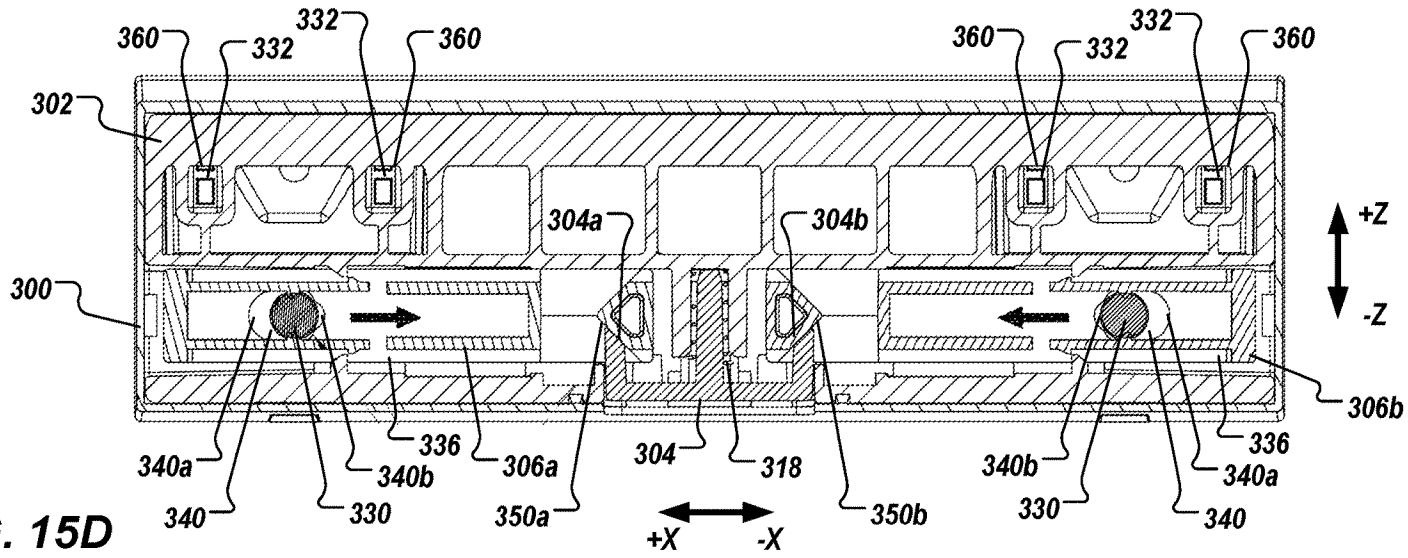

FIGS. 15C and 15D depict respective cross-sectional views along line E-E of FIG. 5. FIG. 15C depicts the latches 306*a*, 306*b* in respective first positions, in which the latches 306*a*, 306*b* are biased against the cover 300 and are seated in the narrows 334 (not visible in FIG. 15C) of the mounting posts 330. FIG. 15D depicts the latches 306*a*, 306*b* in respective second positions, in which the latches 306*a*, 306*b* are moved away from the cover 300 (against the bias of the springs 320*a*, 320*b*) and are unseated from the narrows 334 (not visible in FIG. 15D) of the mounting posts 330.

To move the latches 306*a*, 306*b* from the first positions to the second positions, a force is applied to the release button 304 to induce movement of the release button 304 in a +Z direction against the bias of the spring 318 (the spring 318 biasing the release button in a −Z direction). As the release button 304 moves in the +Z direction, the cam surfaces 304*a*, 304*b* of the release button 304 push against respective cam surfaces 350*a*, 350*b* of the latches 306*a*, 306*b* to move the latches 306*a*, 306*b* to the respective second positions. When in the respective second positions, the hinge assembly 304, and thus the toilet seat system 100, can be pulled from the mounting posts 330 for detachment from the toilet bowl (see, e.g., FIG. 13). Similarly, the hinge assembly 304, and thus the toilet seat system 100, can be mounted onto the mounting posts 330 for attachment of the toilet seat system 100 to the toilet bowl (see, e.g., FIG. 12).

As depicted in FIGS. 15C and 15D, when the hinge assembly 104 is mounted onto the mounting posts 308, the alignment posts 332 are received into alignment openings 360. More particularly, as the hinge assembly 104 is mounted onto the mounting posts 308, the alignment posts 332 slide into the alignment openings 360 to guide the hinge assembly 104 and properly orient the hinge assembly 104, and thus the toilet seat assembly 100 on the toilet bowl.

While this specification contains many specifics, these should not be construed as limitations on the scope of the disclosure or of what may be claimed, but rather as descriptions of features specific to particular implementations. Certain features that are described in this specification in the context of separate implementations may also be implemented in combination in a single implementation. Conversely, various features that are described in the context of a single implementation may also be implemented in multiple implementations separately or in any suitable sub-combination. Moreover, although features may be described above as acting in certain combinations and even initially claimed as such, one or more features from a claimed combination may in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems may generally be integrated together in a single software product or packaged into multiple software products.

A number of implementations have been described. Nevertheless, it will be understood that various modifications may be made without departing from the spirit and scope of the disclosure. For example, various forms of the flows shown above may be used, with steps re-ordered, added, or removed. Accordingly, other implementations are within the scope of the following claims.

What is claimed is:

1. A toilet seat system, comprising:
   - a raised toilet seat having a set of cavities formed therein, cavities in the set of cavities being configured to receive inserts; and
   - a handrail comprising a rail and a first insert that is releasably secured within a first cavity of the set of cavities, the first insert being insertable into the first cavity in a horizontal direction.

2. The toilet seat system of claim 1, wherein the handrail further comprises a second insert that can be releasably secured within a second cavity of the set of cavities.

3. The toilet seat system of claim 1, wherein the first insert comprises a quick-release mechanism that is configured to releasably secure the first insert within the first cavity.

4. The toilet seat system of claim 3, wherein the quick-release mechanism comprises a button that is selectively receivable within an opening to releasably secure the first insert within the first cavity.

5. The toilet seat system of claim 3, wherein the first cavity comprises a sloping surface that acts on the quick-release mechanism when the first insert is inserted into the first cavity.

6. The toilet seat system of claim 1, further comprising a hinge assembly comprising a quick-detachment mechanism that is configured to releasably secure the toilet seat system to a toilet bowl.

7. The toilet seat system of claim 6, wherein the quick-detachment mechanism comprises:

a mounting bracket that is secured to the toilet bowl;

a latch that is movable between a first position and a second position, in the first position, the latch being engaged with the mounting bracket and, in the second position, the latch being disengaged from the mounting bracket; and a release button that is movable to induce movement of the latch from the first position to the second position.

8. The toilet seat system of claim 1, wherein each cavity in the set of cavities is integrally formed within the raised toilet seat.

9. The toilet seat system of claim 1, further comprising a plug that is releasably secured within a second cavity of the set of cavities.

10. The toilet seat system of claim 1, wherein the rail is a tubular rail.

11. The toilet seat system of claim 1, further comprising a lid.

12. A toilet seat system, comprising:

a raised toilet seat having a set of cavities formed therein, cavities in the set of cavities being configured to receive inserts;

a first handrail comprising a first rail, a first insert, and a second insert, the first insert being releasably secured within a first cavity of the set of cavities and being insertable into the first cavity in a horizontal direction, the second insert being releasably secured within a second cavity of the set of cavities;

a second handrail comprising a second rail, a third insert, and a fourth insert, the third insert being releasably secured within a third cavity of the set of cavities, the fourth insert being releasably secured within a fourth cavity of the set of cavities; and a hinge assembly comprising a quick-detachment mechanism that is configured to releasably secure the toilet seat system to a toilet bowl.

13. The toilet seat system of claim 12, wherein the first insert comprises a quick-release mechanism that is configured to releasably secure the first insert within the first cavity.

14. The toilet seat system of claim 12, wherein the quick-detachment mechanism comprises:

a mounting bracket that is secured to the toilet bowl;

a latch that is movable between a first position and a second position, in the first position, the latch being engaged with the mounting bracket and, in the second position, the latch being disengaged from the mounting bracket; and a release button that is movable to induce movement of the latch from the first position to the second position.

15. The toilet seat system of claim 12, wherein each of the first cavity, the second cavity, the third cavity, and the fourth cavity is integrally formed within the raised toilet seat.

16. The toilet seat system of claim 12, further comprising a plug that is releasably secured within one of the first cavity, the second cavity, the third cavity, and the fourth cavity when one of the first insert, the second insert, the third insert, and the fourth insert is withdrawn from the raised toile seat.

17. The toilet seat system of claim 12, wherein the first rail and the second rail are each a tubular rail.

18. The toilet seat system of claim 12, further comprising a lid.

* * * * *